US008807144B2

(12) United States Patent
Hampl, Jr. et al.

(10) Patent No.: US 8,807,144 B2
(45) Date of Patent: Aug. 19, 2014

(54) WRAPPERS FOR SMOKING ARTICLES HAVING REDUCED DIFFUSION LEADING TO REDUCED IGNITION PROCLIVITY CHARACTERISTICS

(75) Inventors: Vladimir Hampl, Jr., Roswell, GA (US); Alice Gu, Duluth, GA (US); James Rossi-Espagnet, Atlanta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 850 days.

(21) Appl. No.: 12/035,045

(22) Filed: Feb. 21, 2008

(65) Prior Publication Data

US 2008/0202542 A1 Aug. 28, 2008

Related U.S. Application Data

(60) Provisional application No. 60/903,018, filed on Feb. 23, 2007.

(51) Int. Cl.

| | |
|---|---|
| ***A24D 1/00*** | (2006.01) |
| ***A24D 1/02*** | (2006.01) |
| ***D21H 11/00*** | (2006.01) |
| ***D21H 13/00*** | (2006.01) |

(52) U.S. Cl.
USPC ..... 131/365; 131/360; 131/334

(58) Field of Classification Search
USPC ..... 131/365; 162/139
See application file for complete search history.

(56) References Cited

U.S. PATENT DOCUMENTS

| | | | |
|---|---|---|---|
| 3,744,496 | A | 7/1973 | McCarty et al. |
| 4,225,636 | A | 9/1980 | Cline et al. |
| 4,318,959 | A | 3/1982 | Evans et al. |
| 4,411,279 | A | 10/1983 | Martin et al. |
| 4,420,002 | A | 12/1983 | Cline |
| 4,453,553 | A | 6/1984 | Cohn |
| 4,461,311 | A | 7/1984 | Mathews et al. |
| 4,480,644 | A | 11/1984 | Luke |
| 4,497,331 | A | 2/1985 | Nellen |

(Continued)

FOREIGN PATENT DOCUMENTS

| | | | |
|---|---|---|---|
| EP | 0447094 | A1 | 9/1991 |
| EP | 0513985 | A1 | 11/1992 |

(Continued)

OTHER PUBLICATIONS

International Search Report for Application No. PCT/US2008/054522, mailed Jul. 8, 2008.

*Primary Examiner* — Richard Crispino
*Assistant Examiner* — Phu Nguyen
(74) *Attorney, Agent, or Firm* — Dority & Manning, P.A.

(57) ABSTRACT

Smoking articles having reduced ignition proclivity characteristics are disclosed. The smoking articles include a wrapper comprising cellulosic fibers and a filler. In accordance with the present disclosure, the filler has a particle size of at least about 3.2 microns and is present in the wrapper in an amount less than about 20% by weight. Further, the wrapper may have a basis weight of less than about 23 gsm and a permeability of from about 15 Coresta to about 110 Coresta. It has been discovered that such wrappers are capable of reducing the ignition proclivity characteristics of a smoking article. If desired, the particular wrapper as described above can also contain discrete areas treated with an ignition reducing composition which further serves to reduce the ignition proclivity characteristics of the article.

27 Claims, 1 Drawing Sheet

(56) References Cited

U.S. PATENT DOCUMENTS

| | | | | |
|---|---|---|---|---|
| 4,502,282 | A | 3/1985 | Kanesaka | |
| 4,503,118 | A | 3/1985 | Murakami et al. | |
| 4,548,677 | A | 10/1985 | Schneider et al. | |
| 4,615,345 | A | 10/1986 | Durocher | |
| 4,622,983 | A | 11/1986 | Mathews et al. | |
| 4,725,318 | A | 2/1988 | Minayoshi et al. | |
| 4,732,748 | A | 3/1988 | Stewart et al. | |
| 4,739,775 | A | 4/1988 | Hampl, Jr. | |
| 4,779,631 | A | 10/1988 | Durocher et al. | |
| 4,805,644 | A | 2/1989 | Hampl, Jr. et al. | |
| 4,821,749 | A | 4/1989 | Toft et al. | |
| 4,881,557 | A | 11/1989 | Martin | |
| 4,915,118 | A | 4/1990 | Kaufman et al. | |
| 4,924,888 | A | 5/1990 | Perfetti et al. | |
| 4,984,589 | A | 1/1991 | Riedesser | |
| 4,986,285 | A | 1/1991 | Radzio et al. | |
| 4,998,543 | A | 3/1991 | Goodman et al. | |
| 5,017,864 | A | 5/1991 | Kaida et al. | |
| 5,060,674 | A | 10/1991 | Brown et al. | |
| 5,060,675 | A | 10/1991 | Milford et al. | |
| 5,074,321 | A | 12/1991 | Gentry et al. | |
| 5,103,844 | A | 4/1992 | Hayden et al. | |
| 5,105,835 | A | 4/1992 | Drewett et al. | |
| 5,107,866 | A | 4/1992 | Aronoff et al. | |
| 5,109,876 | A | 5/1992 | Hayden et al. | |
| 5,143,098 | A | 9/1992 | Rogers et al. | |
| 5,144,967 | A | 9/1992 | Cartwright et al. | |
| 5,152,304 | A | 10/1992 | Bokelman et al. | |
| 5,156,719 | A | 10/1992 | Passaretti | |
| 5,161,551 | A | 11/1992 | Sanders et al. | |
| 5,168,884 | A | 12/1992 | Baldwin et al. | |
| 5,170,807 | A | 12/1992 | Kasbo et al. | |
| 5,172,708 | A | 12/1992 | Drewett et al. | |
| 5,215,734 | A | 6/1993 | Kunesh et al. | |
| 5,227,025 | A | 7/1993 | Kunesh et al. | |
| 5,228,464 | A | 7/1993 | Owens, Jr. | |
| 5,253,660 | A | 10/1993 | Dixit et al. | |
| 5,259,404 | A | 11/1993 | Case et al. | |
| 5,263,500 | A | 11/1993 | Baldwin et al. | |
| 5,263,999 | A | 11/1993 | Baldwin et al. | |
| 5,271,419 | A | 12/1993 | Arzonico et al. | |
| 5,302,437 | A | 4/1994 | Idei et al. | |
| 5,307,823 | A | 5/1994 | Jones et al. | |
| 5,327,916 | A | 7/1994 | Jones et al. | |
| 5,360,023 | A | 11/1994 | Blakley et al. | |
| 5,385,158 | A | 1/1995 | Owens, Jr. | |
| 5,404,890 | A | 4/1995 | Gentry et al. | |
| 5,417,228 | A | 5/1995 | Baldwin et al. | |
| 5,450,862 | A | 9/1995 | Baldwin et al. | |
| 5,450,863 | A | 9/1995 | Collins et al. | |
| 5,730,840 | A | 3/1998 | Hampl, Jr. et al. | |
| 5,820,998 | A | 10/1998 | Hotaling et al. | |
| 5,878,753 | A | 3/1999 | Peterson et al. | |
| 5,878,754 | A | 3/1999 | Peterson et al. | |
| 5,888,348 | A | 3/1999 | Hampl, Jr. | |
| 5,893,372 | A | 4/1999 | Hampl, Jr. | |
| 5,921,249 | A | 7/1999 | Hampl, Jr. | |
| 6,257,243 | B1 | 7/2001 | Muller et al. | |
| 6,568,403 | B2 * | 5/2003 | Hampl et al. | 131/365 |
| 6,817,365 | B2 | 11/2004 | Hajaligol et al. | |
| 6,935,346 | B2 | 8/2005 | Bushby et al. | |
| 7,216,652 | B1 | 5/2007 | Fournier et al. | |
| 2003/0136420 | A1 * | 7/2003 | Kraker | 131/360 |
| 2004/0007242 | A1 | 1/2004 | Finlay et al. | |
| 2005/0034739 | A1 | 2/2005 | Dittrich et al. | |
| 2006/0130862 | A1 | 6/2006 | Dittrich et al. | |
| 2009/0044819 | A1 * | 2/2009 | Fritzsching | 131/365 |

FOREIGN PATENT DOCUMENTS

| | | | |
|---|---|---|---|
| EP | 0533423 | A1 | 3/1993 |
| EP | 0791688 | A1 | 8/1997 |
| EP | 1623636 | A1 | 2/2006 |
| GB | 2028832 | A | 3/1980 |
| WO | WO0141590 | A1 | 6/2001 |
| WO | WO0224006 | A2 | 3/2002 |
| WO | WO03077687 | A2 | 8/2003 |
| WO | WO2006042817 | A2 | 4/2006 |

* cited by examiner

WRAPPERS FOR SMOKING ARTICLES HAVING REDUCED DIFFUSION LEADING TO REDUCED IGNITION PROCLIVITY CHARACTERISTICS

RELATED APPLICATIONS

The present application is based on and claims priority to U.S. Provisional Patent Application Ser. No. 60/903,018 filed on Feb. 23, 2007.

BACKGROUND

There is an ongoing concern in the tobacco industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles to ignite surfaces and materials used in furniture, bedding, and the like upon contact.

Thus, a desirable feature of smoking articles, particularly cigarettes, is that they tend to self-extinguish upon being dropped or left in a free burning state on combustible materials.

It has long been recognized in the tobacco industry that the cigarette wrapper can have a significant influence on the smolder characteristics of the cigarette. In this regard, various attempts have been made in the art to alter or modify the cigarette wrappers in order to achieve the desired tendency of the cigarette to self-extinguish, or in other words to reduce the ignition proclivity characteristics of cigarettes.

The prior art describes the application of film-forming solutions to cigarette paper to reduce the paper permeability and control the burn rate. It has been shown that when these materials have been applied in discrete areas along the length of the cigarette, the cigarette shows a reduced propensity to ignite a substrate, tends to self-extinguish, and has a higher puff count.

U.S. Pat. No. 5,878,753 to Peterson and U.S. Pat. No. 5,820,998 to Hotaling, et al. which are incorporated herein by reference, for example, describe a smoking article wrapper being treated with a film-forming aqueous solution to reduce permeability. U.S. Pat. No. 5,878,754 to Peterson which is also incorporated herein by reference describes a smoking article wrapper being treated with a non-aqueous solution of a solvent soluble polymer dissolved in a non-aqueous solution to reduce permeability.

Although many improvements have been made in the art, there is still a need for an improved method for producing a cigarette wrapper with reduced ignition proclivity properties. For example, many prior art wrappers as described above include discrete areas that provide reduced ignition propensity characteristics to a smoking article. What is needed is a wrapper that is capable of providing a smoking article with reduced ignition propensity characteristics over the entire surface of the wrapper. For instance, various benefits and advantages would be obtained if a wrapper could be constructed that inherently reduces the ignition propensity characteristics of a smoking article due to the materials that are used to construct the wrapper as opposed to having to apply further compositions to the wrapper after the wrapper is produced. Alternatively, such a wrapper may synergistically be combined with treating the wrapper with reduced ignition proclivity compositions.

SUMMARY

The present disclosure is generally directed to paper wrappers for smoking articles with reduced ignition proclivity and to a process for making the wrappers. For example, in one embodiment, the paper wrapper can be made from a paper web. The paper wrapper can contain flax fibers, softwood fibers, hardwood fibers and mixtures thereof.

In accordance with the present disclosure, the wrapper further comprises a filler having a relatively large particle size. For instance, the filler can have a median particle size of greater than about 3.2 microns, such as from about 3.2 microns to about 12 microns. For example, in one embodiment, the filler may have a particle size of from about 3.5 microns to about 8 microns, such as from about 3.5 microns to about 5.5 microns. The filler can be made from any suitable material, such as a carbonate or an oxide. Examples of fillers that may be used in the present disclosure, for instance, include calcium carbonate and magnesium oxide.

In addition to having a relatively large particle size, the filler can be present in the paper wrapper in relatively low amounts. For instance, the wrapper can contain the filler in an amount less than about 20% by weight, such as from about 10% to about 16% by weight. Further, the wrapper can have a relatively low basis weight. For example, the basis weight of the wrapper can be less than about 23 gsm, such as from about 18 gsm to about 21 gsm.

It has been discovered by the present inventors that paper wrappers made as described above, when incorporated into a smoking article, create a smoking article having reduced ignition proclivity characteristics. Further, the above wrappers can be made and can confer reduced ignition proclivity characteristics to a smoking article while having a permeability within relatively normal ranges. For instance, the permability of the wrapper may be from about 15 Coresta to about 80 Coresta, such as from about 25 Coresta to about 60 Coresta.

Smoking articles containing wrappers made according to the present invention can have an ASTM Test No. E2187-04 pass rating of at least about 75% indicating that the smoking articles are substantially prevented from igniting an adjacent surface. Further, such smoking articles can be made so that smoking articles have a free air self-extinguishment rating of less than about 50%, such as less than about 30%.

Although optional, in one embodiment, the wrapper can further include discrete areas treated with a reduced ignition composition. The treated discrete areas can be present on the wrapper separated by untreated areas. The discrete areas may contain sufficient amounts of the reduced ignition composition to further reduce ignition proclivity of the smoking article in those particular areas. For example, the treated areas can further reduce ignition proclivity by reducing oxygen to a smoldering coal of the smoking article as the coal burns and advances into the treated areas.

The reduced ignition composition can be made from any suitable material. For example, in one embodiment, the reduced ignition composition may comprise a cellulose material applied to the wrapper. In other embodiments, the reduced ignition composition may comprise a film-forming material. The film-forming material may comprise, for instance, an alginate, such as sodium or potassium alginate. It should be understood, however, that various other film-forming materials can be used. Other film-forming materials may include, for instance, guar gum, pectin, polyvinyl alcohol, polyvinyl acetate, cellulose derivatives such as ethyl cellulose, methyl cellulose, carboxymethyl cellulose, starch, and starch derivatives.

The reduced ignition composition can be applied to the paper wrapper according to various methods. For example, the composition can be printed onto the paper using, for instance, flexography, direct gravure printing, and offset gravure printing.

In one embodiment, the discrete areas formed by the reduced ignition composition are in the shape of circumferential bands disposed longitudinally along the smoking article. The bands can have a width of greater than about 3 mm, such as from about 4 mm to about 10 mm. The bands can be spaced from each other at a distance of from about 5 mm to about 50 mm and particularly from about 10 mm to about 40 mm.

The amount of the reduced ignition composition that is applied to the paper wrapper depends upon the particular application and various factors. For example, the composition can be applied to the wrapper in an amount from about 1% to about 30% by weight based upon the weight of the wrapper within the treated areas, and particularly in an amount from about 2% to about 20% by weight.

The reduced ignition composition when applied to the paper wrapper may be contained in an aqueous solution or may be contained in a non-aqueous solution. When contained in a non-aqueous solution, for example, an alcohol may be present.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
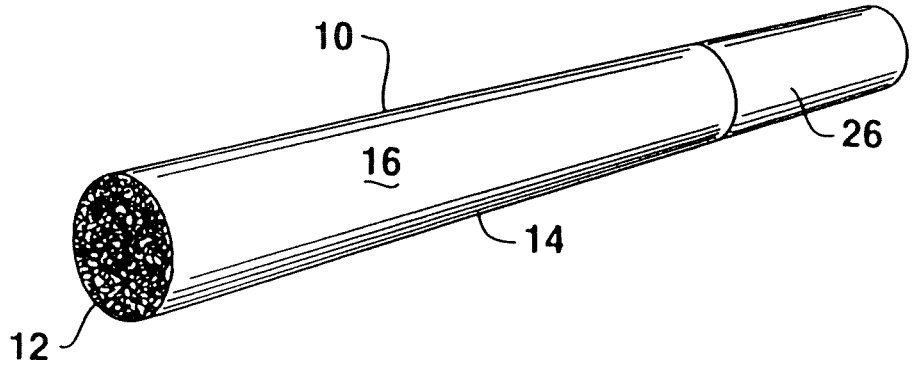
FIG. 1 is a perspective view of one embodiment of a smoking article made in accordance with the present disclosure.

Repeat use of reference characters in the present specification and drawings is intended to represent same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

For purposes of explanation of the invention, the embodiments and principles of the invention will be discussed in regards to a cigarette. However, this is for the purposes of explanation of the invention only and is not meant to limit the invention only to cigarettes. Any suitable type of smoking article is within the scope and spirit of the invention.

The present disclosure relates to a smoking article, and to a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Another test for ignition proclivity is referred to as the "Cigarette Extinction Test" which is ASTM Test No. E2187-04 using 10 layers of filter paper. In the Cigarette Extinction Test, a lit cigarette is placed on 10 layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

In addition to the above tests, smoking articles having reduced ignition proclivity characteristics are typically also tested for "free air self-extinguishment" (FASE). During the free air extinguishment test, the smoking articles are allowed to burn in the free air (within a fume hood while being held by a pin) without being puffed and without being placed on an adjacent surface. In most applications, it is desirable for a smoking article to pass the mock up ignition test or the cigarette extinction test while not self-extinguishing when left burning in the free air. Thus, lower FASE rates are preferred. Of particular advantage, smoking articles constructed in accordance with the principles of the present invention may be configured to self extinguish when placed on an adjacent surface but yet have lower FASE rates in comparison to many prior products that are intended to have reduced ignition proclivity characteristics.

In general, the present disclosure is directed to a wrapper having a particular and desired construction that is capable of reducing the ignition proclivity characteristics of a smoking article. Of particular advantage, the entire wrapper reduces ignition proclivity of the smoking article as opposed to many prior art wrapper constructions where ignition proclivity is only reduced in certain areas. Also of particular advantage, as will be described in more detail below, the wrapper can reduce the ignition proclivity characteristics of a smoking article while having a conventional permeability and without adversely affecting other properties of the smoking article such as taste, smoke delivery, appearance, etc.

Wrappers are made according to the present disclosure by incorporating into the wrapper a filler having a relatively large particle size. In the past, one of the present inventors had discovered that the burn rate of a paper wrapper for a cigarette may be reduced by incorporating relatively large particles into the wrapper. For instance, U.S. Pat. No. 6,568,403, which is incorporated herein by reference, is directed to a paper wrapper for the reduction of cigarette burn rate. The '403 patent states that the total filler level in the paper can be from about 20% by weight to about 45% by weight. In one embodiment of the present disclosure, however, a wrapper is constructed containing a filler having a relatively large particle size at levels less than about 20% by weight. Such a wrapper has been found to provide various advantages and benefits. For example, the present inventors discovered that, in some embodiments, when the filler levels are greater than about 20% by weight, the smoking article may have a tendency to self-extinguish when left burning in the free air and thus have unacceptable FASE rates. In this regard, the present disclosure is directed to a wrapper for a smoking article that not only has dramatically improved reduced ignition proclivity properties, but also has acceptable FASE rates. In addition, the wrapper can be designed to have other properties that do not adversely interfere with the taste of the smoking article or other characteristics of the smoking article including puff count, etc.

Wrappers made according to the present invention generally contain cellulosic fibers mixed with the filler having the relatively large particle size. The cellulosic fibers may comprise, for instance, flax, softwood fibers, hardwood fibers, and mixtures thereof. The filler, for instance, can have a particle size of at least about 3.2 microns. For instance, the filler can have a particle size of from about 3.2 microns to about 12 microns, such as from about 3.5 microns to about 8 microns, such as from about 3.5 microns to about 5.5 microns. In comparison, conventionally used fillers incorporated into wrappers in the past generally had a particle size of less than 2 microns. As used herein, the median particle size of the filler is measured using any suitable particle size analyzer such as a SEDIGRAPH marketed by Micromeritics Instrument Corporation of Norcross, Ga.

In addition to using a filler having a relatively large particle size, the total filler loading in the wrapper can also be reduced in comparison to conventional filler levels. For instance, wrappers made according to the present disclosure may contain the filler in an amount less than about 20% by weight, such as from about 10% to about 16% by weight. For example, in one particular embodiment, the filler loading in the wrapper may be from about 11% to about 13% by weight.

In general, any suitable filler having the appropriate size can be incorporated into the wrapper. For many applications, for instance, the filler is white in color. The filler may comprise, for instance, a carbonate or an oxide. Particular examples of filler particles that may be used include calcium carbonate, magnesium oxide, and mixtures thereof.

In some applications, the basis weight of the wrapper is relatively low. For instance, the basis weight of the wrapper can be less than about 23 gsm, such as less than about 21 gsm. For example, in one particular embodiment, the basis weight of the wrapper can be from about 18 gsm to about 21 gsm.

Of particular advantage, wrappers made according to the present disclosure can be designed to have a paper permeability that is somewhat similar to conventional wrappers, while still reducing the ignition proclivity characteristics of the smoking article. For example, the permeability of the wrapper can be less than about 200 Coresta, such as from about 15 Coresta to about 120 Coresta. The permeability of the wrapper can be designed for the particular application. In one embodiment, for instance, the permeability of the wrapper can be from about 18 Coresta to about 80 Coresta, such as from about 30 Coresta to about 80 Coresta, such as from about 35 Coresta to about 75 Coresta.

Although unknown, the present inventors believe that the relatively large particle size of the filler when incorporated into a wrapper in accordance with the present disclosure restricts the diffusion of oxygen through the wrapper when a smoking article is lit, while yet maintaining paper permeability similar to conventional levels. More particularly, it is believed that the large particles form greater pore sizes in the paper that allow for higher permeabilities while providing less pathways for oxygen diffusion to the burning coal when the smoking article is lit. By restricting diffusion of oxygen to the burning coal, the wrapper effectively reduces the ignition proclivity characteristics of the article.

Referring to FIG. 1, one embodiment of a smoking article 10 made in accordance with the present disclosure is shown. As illustrated, the smoking article 10 includes a tobacco column 12 within a wrapper 14. In general, the tobacco column 12 can be made using any suitable tobacco material. For instance, the tobacco material may comprise flue-cured tobacco, burley tobacco, Turkish leaf tobacco, aromatic tobacco, reconstituted tobacco sheets, and mixtures thereof. The tobacco material may include tobacco dust, tobacco laminate, tobacco cut-filler, volume-expanded tobacco, scrap tobacco, tobacco stems and stalks and tobacco in whole leaf form.

The packing density of the tobacco filler may vary depending upon the particular application. In general, for instance, the packing density of the tobacco filler may be from about 150 mg/cm$^3$ to about 350 mg/cm$^3$, such as from about 200 mg/cm$^3$ to about 320 mg/cm$^3$. In one embodiment, for instance, the packing density may be from about 240 mg/cm$^3$ to about 280 mg/cm$^3$.

In addition to tobacco material, the tobacco column 12 may also include various other additives including binders, inorganic fillers, carbon, carbonized material, activated carbon, and other components. For instance, in one embodiment, various components can be added to the tobacco column 12 that decompose on heating and release oxygen.

The wrapper 14 is made as described above containing a filler having a median particle size of at least about 3.2 microns. The wrapper provides the smoking article 10 with improved ignition proclivity characteristics.

As shown, the smoking article 10 may further include a filter 26. The filter 26 is attached to one end of the tobacco column 12. It should be understood, however, that in other embodiments a filter may not be necessary.

One measurement that can be used to indicate reduced ignition proclivity properties is Burn Mode Index. The test for determining Burn Mode Index is explained in U.S. Pat. No. 4,739,775 to Hampl, which is incorporated herein by reference.

In general, wrappers made according to the present disclosure can be produced so as to have any desirable Burn Mode Index (BMI). Of particular advantage, the wrapper 14 generally has a Burn Mode Index that is uniform across the entire surface area of the wrapper. In general, the Burn Mode Index of the wrapper 14 can be less than about 8 cm$^{-1}$, and particularly less than about 5 cm$^{-1}$. For instance, in one embodiment, the BMI of the wrapper 14 can be from about 1 cm$^{-1}$ to about 3 cm$^{-1}$.

Ultimately, the smoking article 10 as shown in FIG. 1 can be constructed so as to pass the Mock-Up Ignition Test or the Cigarette Extinction Test. For instance, smoking articles made in accordance with the present disclosure can have an ASTM Test No. E2187-04 pass rating of at least about 75%, such as at least about 90% and, in one embodiment, can have a rating of 100%.

Of particular advantage, the smoking article 10 can have reduced ignition proclivity characteristics while also being configured so that the smoking article does not self-extinguish when left in a free air burning state, such as when the smoking article is being held and not puffed or when the smoking article is propped in an ashtray. For instance, the smoking article 10 can also have a free air self-extinguishment rating of less than about 50%, such as less than about 30%, such as less than about 10%.

It should be understood that the wrapper of the present disclosure can be used by itself to reduce the ignition proclivity characteristics of a smoking article or may be used in combination with chemical treatments. For instance, in one embodiment, discrete areas on the wrapper may be treated with an ignition reducing composition to further reduce the ignition proclivity characteristics of the smoking article within the treated areas.

Figure 2:
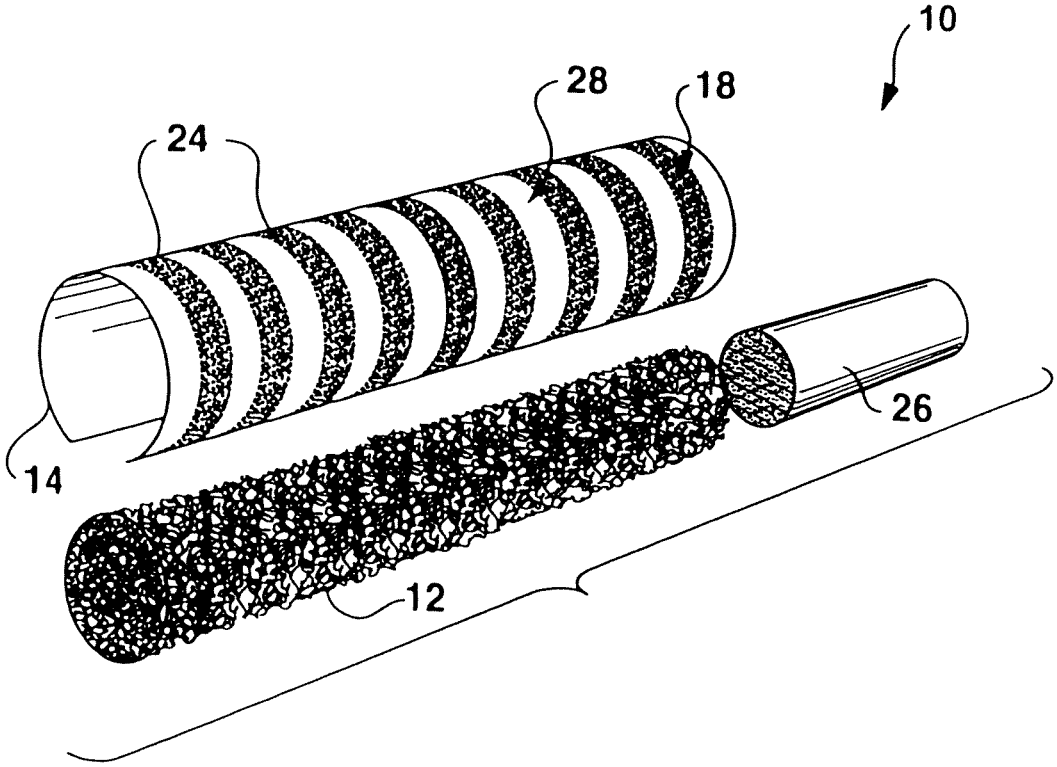
FIG. 2 is an exploded view of another embodiment of a smoking article made in accordance with the present disclosure.

For example, referring to FIG. 2, an alternative embodiment of a smoking article 10 made in accordance with the present disclosure is illustrated. Like reference numerals have been used to indicate similar elements in comparison to FIG. 1.

As shown, the smoking article 10 includes a tobacco column 12 surrounded by a wrapper 14. If desired, the smoking article 10 can further include a filter 26.

In this embodiment, the smoking article 10 further includes discrete areas 18 that are treated with an ignition reducing composition.

In the embodiment illustrated in FIG. 2, treated areas 18 are defined as circumferential cross-directional bands 24. Bands 24 are spaced apart from each other longitudinally along the length of the smoking article 10. The bands 24 are indicated in phantom in FIG. 2. However, it should be understood that the treated areas can be essentially invisible in the formed smoking article. In other words, a smoker may not discern from any outward sign that the wrapper 14 has been treated in discrete areas 18. In this regard, treated areas 18 may have a smooth and flat texture essentially the same as untreated areas 28.

The width and spacing of bands 24 are dependent on a number of variables, such as the initial permeability of the wrapper 14, the density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing.

The spacing between bands 24 is also a factor of a number of variables. The spacing should not be so great that the cigarette burns for a sufficient length of time to ignite a substrate before the coal ever burns into a treated area 18. The spacing between bands 24 also affects the thermal inertia of the burning coal, or the ability of the coal to burn through the treated bands 24 without self-extinguishing. It should be understood that the band spacing can be any suitable width as determined by any number of variables. For most applications, the smoking article can contain from 1 to about 3 bands.

When the treated areas are used in conjunction with a wrapper made according to the present disclosure, the number of bands, the width of the bands, and the spacing between the bands may be varied in order to optimize the properties. For instance, since the wrapper 14 has inherent reduced ignition proclivity properties, the treated areas may be relatively narrow. For instance, each band can have a width of less than about 10 mm, such as less than about 5 mm, or even less than about 3 mm. For instance, in one embodiment, the bands have a width of from about 0.5 mm to about 4 mm, such as from about 1 mm to less than 3 mm.

The spacing between the bands can also vary widely. For instance, the spacing may be from about 5 mm to about 50 mm, such as from about 10 mm to about 40 mm.

The reduced ignition composition that is applied to the wrapper in accordance with the present disclosure can vary depending upon the particular application and desired result. In one embodiment, for instance, the reduced ignition composition may comprise a cellulosic material, such as cellulosic fibers that are applied to the wrapper 14 during production of the wrapper.

Alternatively, the reduced ignition composition may comprise a film-forming material. For example, film-forming materials that can be used in accordance with the present invention include alginates, guar gum, pectin, polyvinyl alcohol, polyvinyl acetate, cellulose derivatives such as ethyl cellulose, methyl cellulose, and carboxymethyl cellulose, starch, starch derivatives, and the like.

In one particular embodiment, the film-forming material may comprise an alginate. In general, an alginate is a derivative of an acidic polysaccaride or gum which occurs as the insoluble mixed calcium, sodium, potassium and magnesium salt in the *Phaeophyceae* brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer. Commercially available alginates that may be used include KELGIN RL, MANUCOL LD and MANUCOL LB, which are all commercially available from the ISP Corporation.

At the above lower viscosity levels, alginate compositions can be formed at a higher solids content, but yet at a low enough solution viscosity to permit the application of the composition to a paper wrapper using conventional techniques. For example, the solids content of an alginate solution made in accordance with the present invention can be greater than about 6%, particularly greater than about 10%, and more particularly from about 10% to about 20% by weight.

At the above solids levels, alginate compositions used in accordance with the present invention can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate film-forming composition can be adjusted depending upon the manner in which the composition is being applied to the paper. For instance, the solution viscosity of the composition can be adjusted depending upon whether or not the composition is being sprayed onto the paper or printed onto the paper.

In other embodiments, it should also be understood that depending upon the application a relatively high molecular weight alginate may be used. For example, the alginate may have a viscosity of greater than about 500 cP when contained in a 3% by weight aqueous solution at 25° C.

The reduced ignition composition applied to the paper wrapper can contain various other ingredients. For instance, in one embodiment, a filler can be contained within the composition. The filler can be, for instance, calcium carbonate, calcium chloride, calcium lactate, calcium gluconate, and the like. In addition to calcium compounds, other metal compounds can also be included, including similar magnesium compounds.

The reduced ignition composition, in one embodiment, can be water based. In particular, the reduced ignition composition may comprise an aqueous dispersion or aqueous solution. Alternatively, the reduced ignition composition prior to being applied to the paper wrapper may comprise a non-aqueous solution or dispersion. In this embodiment, for instance, an alcohol may be present for applying the composition to the wrapper.

Once the film-forming composition is formulated, the composition is applied to the wrapper in discrete areas. The manner in which the composition is applied to the wrapper can vary. For example, the composition can be sprayed, brushed or printed onto the wrapper. To form a treated area, the composition can be applied in a single pass or in a multiple pass operation. For instance, the composition can be applied to the wrapping paper in successive steps in order to form areas on the paper having reduced ignition proclivity. In general, during a multiple pass process, the treated areas can be formed by applying the composition during from about 2 to about 8 passes.

The amount of composition that is added to the paper will depend upon various factors, including the type of composition that is used and the desired result. For most applications, the film-forming composition can be added to the paper in an amount from about 1% to about 30% by weight of the paper within the banded region, and particularly from about 2% to about 20% by weight of the paper within the banded region after the bands have been formed and dried. Although not always the case, generally the amount of the composition applied to the paper will generally increase as the permeability of the paper increases. For instance, for wrapping papers having a permeability of less than about 30 Coresta units, the composition can be applied to a paper in an amount from about 1% to about 15% by weight. For wrapping papers having a permeability greater than about 60 Coresta units, on the other hand, the composition can be applied to the paper in an amount from about 8% to about 30% by weight.

In addition to the reduced ignition composition, various other additives can be applied to the wrapper if desired. For example, in one embodiment, a burn promoting agent may be applied to the wrapper. Examples of burn promoting agents include alkali metal salts, alkaline earth metal salts, and mixtures thereof. In one embodiment, the burn promoting agent may comprise a salt of a carboxylic acid. In particular examples, for instance, the burn promoting agent may comprise an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, and mixtures thereof. In one particular application, for instance, the burn promoting agent may comprise potassium citrate, sodium citrate, potassium succinate, sodium succinate, or mixtures thereof.

Especially in embodiments where compositions are applied to the wrapper, the amount of filler particles contained in the wrapper can vary and, in one embodiment, can be greater than 20% by weight, especially when the wrapper is treated with a burn promoting agent. In addition, the basis weight can also be increased, such as greater than 23 gsm.

In another alternative embodiment, the filler comprising the relatively large particles can also be combined with other fillers and incorporated into the wrapper. In this embodiment, for instance, the total filler loading can be greater than 20% by weight, while still maintaining the filler comprised of the relatively large particle sizes in lesser amounts.

The present disclosure may be better understood with reference to the following example.

EXAMPLE

The following tests were conducted in order to demonstrate the teachings of the present disclosure and to show that wrappers made in accordance with the present disclosure are capable of reducing the ignition proclivity characteristics of a smoking article incorporating the wrapper.

Various paper wrappers were made containing cellulosic fibers in combination with a filler. The filler was contained in the wrapper in an amount of 12% by weight. The filler comprised calcium carbonate having a median particle size of 4.6 microns. The wrappers had a basis weight of 19 gsm.

Three different wrappers were formed having different permeabilities.

Each of the wrappers were then used to form smoking articles containing a column of tobacco. The smoking articles were then tested according to the Cigarette Extinction Test, which is ASTM Test No. E2187-04. In addition, the smoking articles were tested for free air self-extinguishment (FASE).

The following results were obtained:

| Sample No. | Permeability (Coresta) | ASTM Test No. E2187-04 Pass Rate (%) | FASE Rating (%) |
|---|---|---|---|
| 1 | 18 | 100 | 65 |
| 2 | 38 | 100 | 30 |
| 3 | 65 | 75 | 0 |

As shown above, smoking articles made according to the present disclosure not only exhibited reduced ignition proclivity characteristics but also tested favorably for free air self-extinguishment.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A smoking article having reduced ignition proclivity characteristics comprising:

a column comprising a smokable tobacco;

a wrapper surrounding the column of the smokable tobacco, the wrapper comprising cellulosic fibers and at least one filler, wherein the at least one filler comprises a calcium compound, wherein the median particle size of all calcium compounds is greater than 3.2 microns and less than 8 microns, and wherein the at least one filler is present in the wrapper in an amount from about 10% to about 16% by weight;

wherein the wrapper has a basis weight of less than 23 gsm; and wherein the smoking article has an ASTM Test No. E2187-04 pass rating of at least about 75%.

2. A smoking article as defined in claim 1, wherein the wrapper has a BMI of less than about 5 $cm^{-1}$.

3. A smoking article as defined in claim 1, wherein the median particle size of all calcium compounds is from about 3.5 microns to about 8 microns.

4. A smoking article as defined in claim 1, wherein the wrapper has a basis weight of from about 18 gsm to about 21 gsm.

5. A smoking article as defined in claim 1, wherein the wrapper has a permeability of from about 30 Coresta to about 80 Coresta.

6. A smoking article as defined in claim 1, wherein the wrapper has a permeability of from about 35 Coresta to about 75 Coresta.

7. A smoking article as defined in claim 1, wherein the smoking article has a FASE rating of less than about 50%.

8. A smoking article as defined in claim 1, wherein the wrapper further comprises discrete areas treated with a film-forming composition, the treated areas being separated by untreated areas.

9. A smoking article as defined in claim 8, wherein the film-forming composition comprises an alginate, guar gum, pectin, polyvinyl alcohol, polyvinyl acetate, a cellulose derivative, starch, a starch derivative, and mixtures thereof.

10. A smoking article as defined in claim 8, wherein the treated areas are in the shape of circumferential bands disposed longitudinally along the smoking article.

11. A smoking article as defined in claim 1, wherein the at least one filler comprises calcium carbonate.

12. A smoking article as defined in claim 1, wherein a surface of the wrapper does not include areas treated with a reduced ignition composition.

13. A smoking article as defined in claim 1, wherein the smoking article has a FASE rating of less than about 25%.

14. A smoking article as defined in claim 1, wherein the smoking article has a FASE rating of less than about 10%.

15. A smoking article as defined in claim 1, wherein the wrapper contains a second filler, the wrapper having a total filler loading of from about 20% to about 30% by weight.

16. A smoking article having reduced ignition proclivity characteristics comprising:

a column comprising a smokable tobacco;

a wrapper surrounding the column of the smokable tobacco, the wrapper comprising cellulosic fibers and at least one filler, wherein the at least one filler comprises a calcium compound, wherein the median particle size of all calcium compounds is greater than 3.2 microns and less than 8 microns;

wherein the wrapper has a basis weight of less than 23 gsm; and at least one discrete area treated with a reduced ignition composition located on the wrapper, the treated discrete area being separated by untreated areas, the discrete area containing sufficient amounts of the reduced ignition composition to reduce ignition proclivity of the smoking article; and wherein the at least one filler is present in the wrapper in an amount from about 10% to about 16% by weight.

17. A smoking article as defined in claim 16, wherein the wrapper includes a plurality of discrete areas treated with the reduced ignition composition separated by untreated areas.

18. A smoking article as defined in claim 16, wherein the wrapper has a BMI of less than about 5 $cm^{-1}$ within the at least one discrete area.

19. A smoking article as defined in claim 16, wherein the median particle size of all calcium compounds is from about 4 microns to about 8 microns.

20. A smoking article as defined in claim 16, wherein the wrapper has a permeability of from about 15 Coresta to about 80 Coresta.

21. A smoking article as defined in claim 16, wherein the reduced ignition composition comprises an alginate, guar gum, pectin, polyvinyl alcohol, polyvinyl acetate, a cellulose derivative, starch, a starch derivative, and mixtures thereof.

22. A smoking article as defined in claim 16, wherein the treated areas are in the shape of circumferential bands disposed longitudinally along the smoking article.

23. A smoking article as defined in claim 1, wherein the at least one filler comprises calcium carbonate.

24. A smoking article as defined in claim 16, wherein the smoking article has an ASTM Test No. E2187-04 pass rating of at least about 75% and has a FASE rating of less than about 50%.

25. A wrapper for a smoking article comprising:

a paper web comprising cellulosic fibers and at least one filler, wherein the at least one filler comprises a calcium compound, wherein the median particle size of all calcium compounds is greater than 3.2 microns and less than 8 microns, and wherein the at least one filler is present in the wrapper in an amount from about 10% to about 16% by weight, the wrapper having a basis weight of less than 23 gsm and a permeability of from about 15 Coresta to about 80 Coresta.

26. A wrapper as defined in claim 25, wherein the mean particle size of all calcium compounds is from about 3.5 microns to about 8 microns, the wrapper having a basis weight of from about 18 gsm to about 21 gsm and a permeability of from about 35 Coresta to about 75 Coresta.

27. A smoking article as defined in claim 1, wherein the at least one filler comprises calcium carbonate.

* * * * *